US007861390B2

(12) United States Patent
Giagni et al.

(10) Patent No.: US 7,861,390 B2
(45) Date of Patent: Jan. 4, 2011

(54) METHOD OF ATTACHING RAIL PULLS TO EXISTING KITCHEN OR BATHROOM CABINETS HAVING PREVIOUSLY INSTALLED KNOBS OR PULLS

(76) Inventors: Vincent Giagni, 23 Pheasant Dr., Rye, NY (US) 10580; John D. Hyde, 177 Hillcrest Rd., Flemington, NJ (US) 08822

( * ) Notice: Subject to any disclaimer, the term of this patent is extended or adjusted under 35 U.S.C. 154(b) by 922 days.

(21) Appl. No.: 11/788,841

(22) Filed: Apr. 23, 2007

(65) Prior Publication Data

US 2008/0258594 A1 Oct. 23, 2008

(51) Int. Cl.
*B21K 21/16* (2006.01)
*A47B 95/02* (2006.01)

(52) U.S. Cl. ..... 29/401.1; 312/348.6

(58) Field of Classification Search ..... 29/401.1, 29/402.03, 402.08, 402.12, 402.14, 402.17, 29/402.09, 896.5; 312/348.6
See application file for complete search history.

(56) References Cited

U.S. PATENT DOCUMENTS 2,838,966 A * 6/1958 Campbell ..... 408/115 R
4,579,485 A * 4/1986 Connor et al. ..... 408/115 R
5,857,652 A * 1/1999 Yousefzadeh ..... 248/231.61

* cited by examiner

*Primary Examiner*—John C Hong

(57) ABSTRACT

European-style long rail pulls are installed on cabinet doors to replace previously installed knobs or short handles on such cabinet doors. Standoff devices are used to rigidly secure the European-style rail pulls while covering unsightly holes left exposed after removal of the knobs from the cabinet doors. The standoff device is a generally cylindrical body have a flat bottom surface and a bore aligned with the exposed holes on the cabinet doors, and an upper surface shaped and sized to securely grip the long rail about its circumference.

2 Claims, 5 Drawing Sheets

METHOD OF ATTACHING RAIL PULLS TO EXISTING KITCHEN OR BATHROOM CABINETS HAVING PREVIOUSLY INSTALLED KNOBS OR PULLS

FIELD OF THE INVENTION

This invention relates to a method of attaching so-called European-style rail pulls to kitchen or bathroom cabinets having previously installed knobs or pulls. In one aspect, the present invention provides a method for replacing the previously installed knobs or pulls of existing kitchen or bathroom cabinets with more stylish rail pulls while covering the unattractive holes left after removal of such knobs or pulls from the surface of the cabinets.

BACKGROUND OF THE INVENTION

Most kitchen and bathroom doors in the homes as well as other places are usually provided with a knob or a pull located on the outside surface, i.e., the surface facing the user. More recently the trend in construction of kitchen and bathroom cabinets has been to provide the cabinets with so-called European style rail pulls due to their attractiveness and consumer preference. Replacement of existing cabinets with new cabinets having the desired rail pulls can prove to be expensive. Removal of knobs and pulls from existing cabinets to replace them with long stylish rail pulls leave unsightly holes on the surface of the cabinet.

OBJECTS OF THE INVENTION

It is therefore an object of the present invention to provide kitchen and bathroom cabinets with European-style rail pulls for opening and closing the cabinets.

It is also an object of this invention to provide a method of replacing conventional pre-installed knobs or pulls of any existing cabinet with European-style rail pulls without leaving exposed unsightly holes caused by the removal of the knobs or pulls from the surface of the cabinet doors.

SUMMARY OF THE INVENTION

Kitchen and bathroom cabinet doors are provided with stylish rail pulls by removing conventional knobs or short pulls which are conventionally previously installed on such cabinet doors and replacing them with the more attractive European-style rail pulls. The removal of a knob or short rail pull or handle from the top or front of a cabinet door leaves an unsightly hole exposed. Standoff devices are used in accordance with the present invention to install the European-style rail pull and also to cover the exposed hole. The standoff device, which can be of different sizes and dimensions, is a generally cylindrical body having a bottom surface, an upper surface, and a central internally threaded bore or channel which is aligned with the exposed hole. The upper end of the standoff device is sized and shaped to firmly grip the rail pull about its circumference when the rail pull is placed above the front surface of the cabinet door. A securing device such as an externally threaded screw is inserted through the exposed hole of the cabinet door into the bore in the standoff device for a sufficient distance to rigidly secure the standoff device while firmly gripping the rail pull in position.

BRIEF DESCRIPTION OF THE DRAWINGS

In the drawings, wherein like reference numerals are employed to designate like parts.

DETAILED DESCRIPTION OF THE INVENTION

Figure 1A:
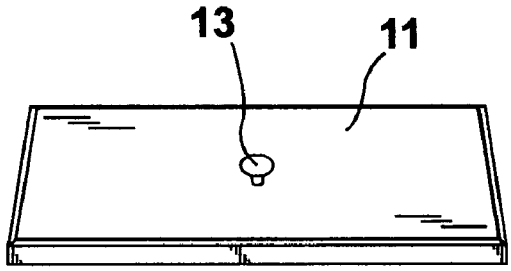
FIG. 1A is a top (front) view of a typical drawer with a pre-installed knob.
Figure 1B:
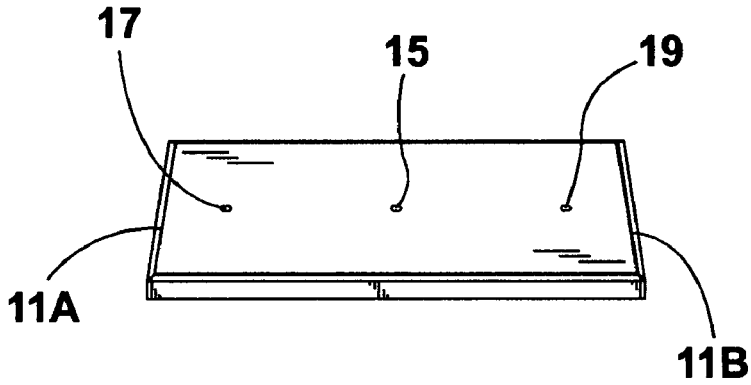
FIG. 1B is the same view as FIG. 1A with the knob removed leaving a hole exposed.

Referring to the drawings, there is shown in FIG. 1A the front (or top) view of drawer 11 having a previously installed knob which can be pulled to open the drawer. In order to install an European-style rail pull, the knob 13 is removed thus leaving a hole 15 as shown in FIG. 1B, which shows the drawer top 11 with the central hole 15 also provided with the holes 17 and 19 formed on each side of the hole 15, preferably equidistantly from the hole 15 and the edges 11A and 11B of the drawer top 11.

Figure 1C:
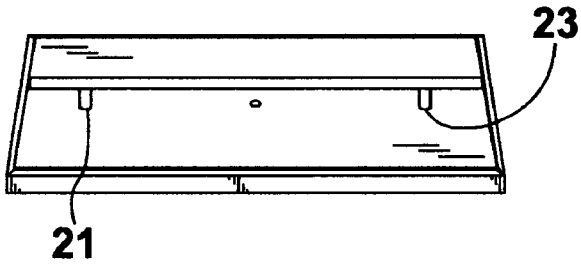
FIG. 1C is a view of the drawer shown in FIG. 1B with an European-style rail pull installed but with the holes exposed.
Figure 5:
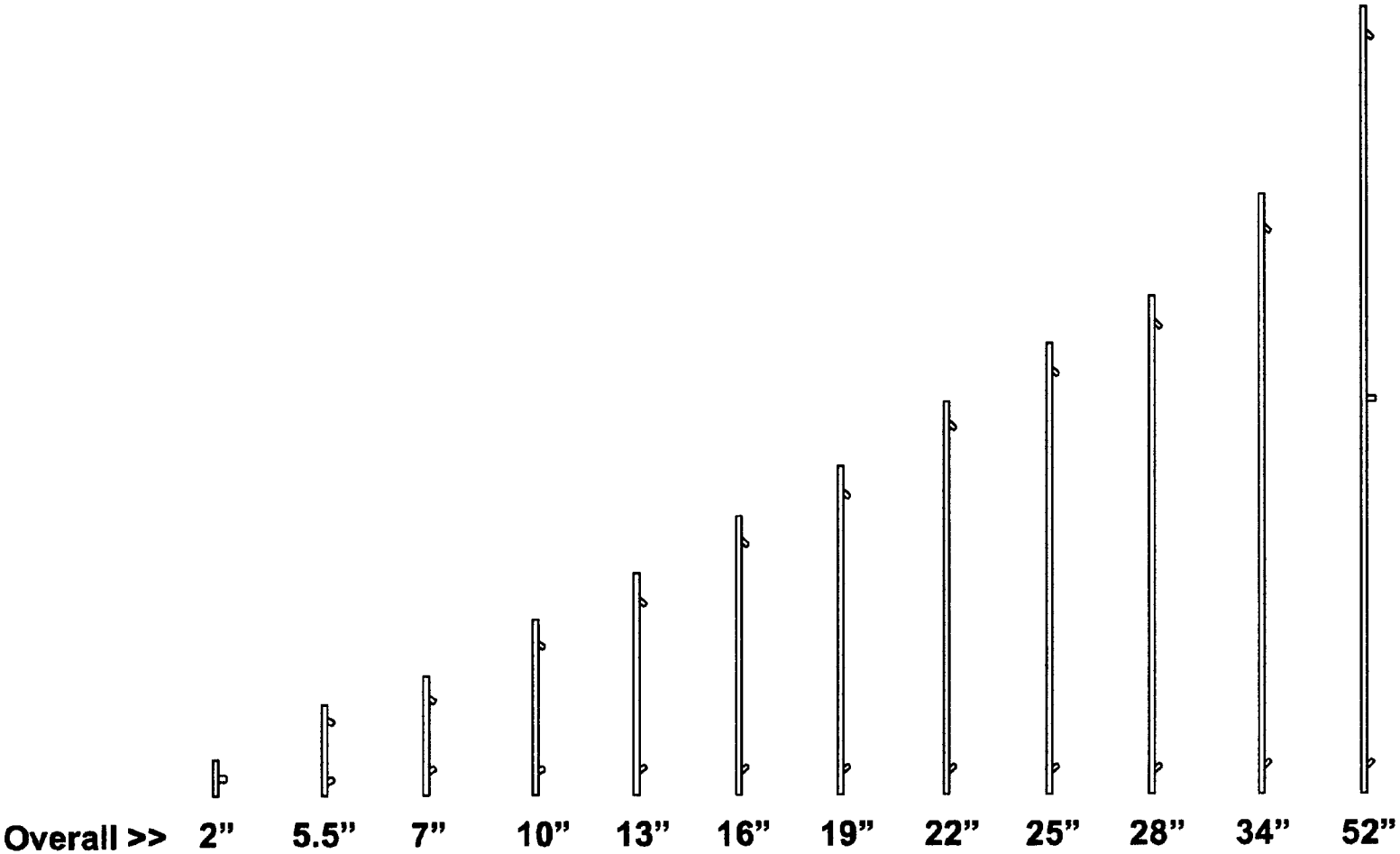
FIG. 5 is a perspective view of a series of rail pulls of various lengths which can be used in the practice of this invention.

In FIG. 1C, the drawer top 11 is shown with installed European-style rail pull 27, as the rail pulls illustrated in FIG. 5, previously installed and secured to drawer top 11 by means of standoffs 21, 23 and 25, in accordance with the present invention. All standoffs used herein are identical in shape and structure, and as shown in FIG. 3C, each has an elongated body portion such as 29, a flat bottom surface 31 and a concave top surface 33 shaped and sized to conformally grip the rail pull 27 securely about its circumference an elongated channel or a bore 35 in formed centrally through the body portion 29 of the standoff extending from a central hole 37 in the bottom of the standoff partly through the standoff body 29, and may be partially threaded internally to threadedly engage an externally threaded screw 39 as shown in FIGS. 3D and 3E.

As shown in FIG. 5, European-style rail pulls are available in a variety of lengths and sizes for use with different size doors and cabinet drawers. In order to install the selected rail pulls on a drawer such as shown in FIG. 1A, after the knob 13 is removed thus exposing the central hole 15, the rail pull 27 is placed over the drawer top 11 and is aligned so that the standoffs 21 and 23 are aligned with the holes 15 and 37, respectively, and are secured to the drawer top 11. These standoffs may previously have been secured to the rail pull. In order to cover the exposed central hole 15, the rail pull 27 is placed above the drawer top with the side standoffs 21,23 previously aligned and secured to the rail pull and to the drawer top 11. The standoff 25 is then placed on the drawer top 11 with the channel 35 aligned with the holes 15 and 37. The externally threaded screw 39 is then inserted through the hole 37 into the elongated internally threaded bore 35, and is advanced sufficient distance to ensure that the top concave surface 23 of the standoff 25 tightly grips the circumference of the rail pull and securely position it on the drawer top 11. Thus the hole 15 will no longer be exposed and the drawer is provided with an attractive European-style rail pull with consumer appeal.

Figure 1D:
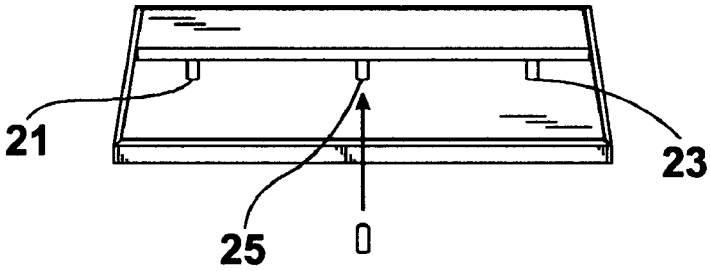
FIG. 1D is the same view as FIG. 1C with the rail pull installed to cover the hole in accordance with the present invention.
Figure 2A:
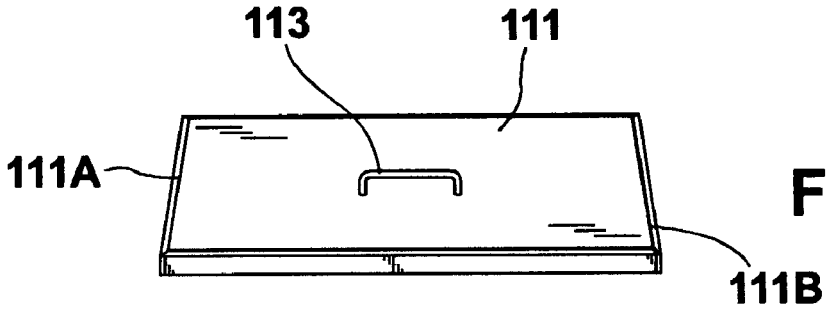
FIG. 2A is a top (front) view of a typical drawer as in FIG. 1A having a pre-installed conventional pull.
Figure 2B:
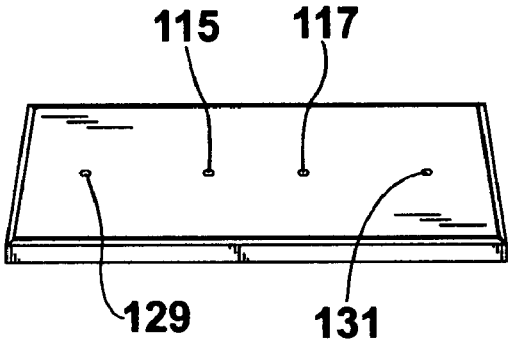
FIG. 2B is the same view as FIG. 2A with the pull removed leaving two holes exposed.
Figure 2C:
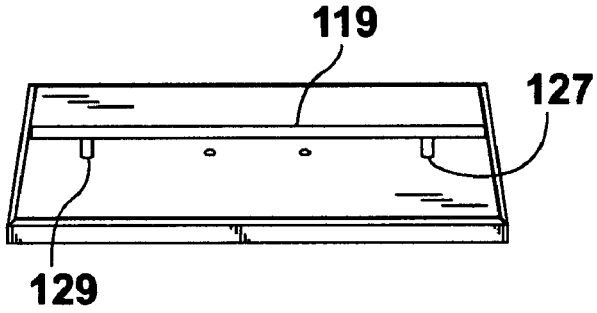
FIG. 2C is a view of the drawer shown in FIG. 2B with an European-style rail pull but with the holes exposed.
Figure 2D:
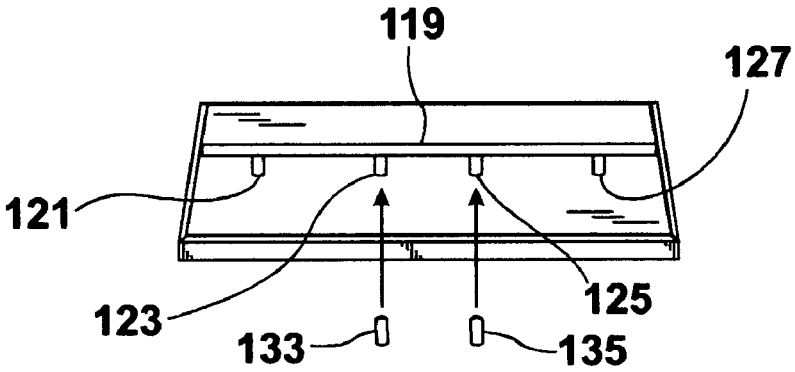
FIG. 2D is the same view as FIG. 2C with the rail pull installed to cover the holes in accordance with the present invention.

In FIG. 2A, the drawer top 111 is shown with a previously installed short rail (handle) 113 which after removal leaves exposed middle holes 115,117 (see FIG. 2B). FIGS. 2C and 2D show the European-style rail pull 119 installed using standoff devices 121, 123, 125, 127. The standoff devices 121,127 may already have been secured to the rail pull 119 and are aligned with the holes 129,131 at the edges 111A, 111B of the cabinet door 111 for balance and stability. The standoff devices 133,135 are aligned with the holes 115,117 and are used to secure the European-style rail pull 119 over the cabinet door in the manner described above in connection with FIGS. 1C and 1D.

Figure 3A:
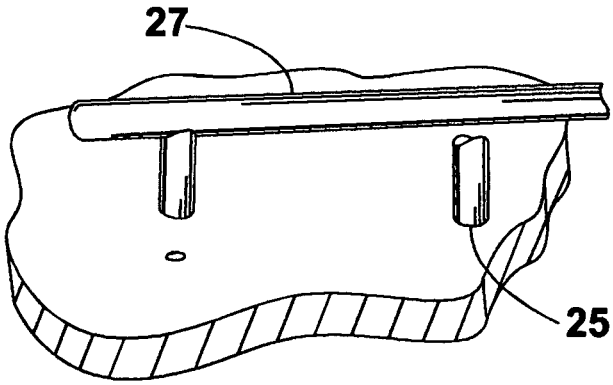
FIG. 3A is a view of the top of a drawer (or a cabinet) showing the method of installation of a rail pull using a stand-off as illustrated in FIG. 3C.
Figure 3B:
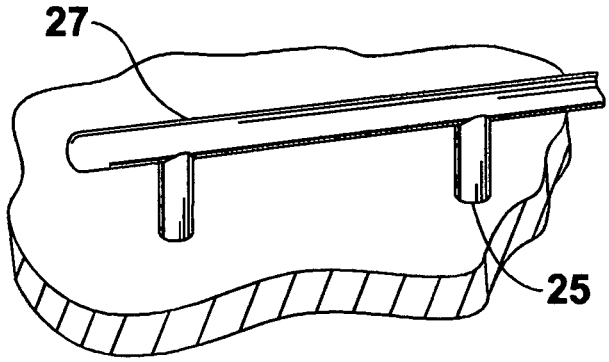
FIG. 3B is the same view as FIG. 3A with the installation of the rail pull being complete.
Figure 3C:
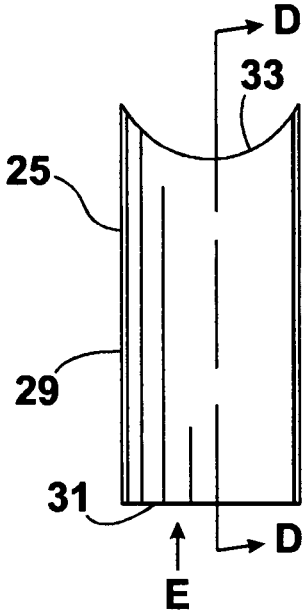
FIG. 3C is an elevational, partly perspective view of the standoff used to secure the rail pull according to the present invention.
Figure 3D:
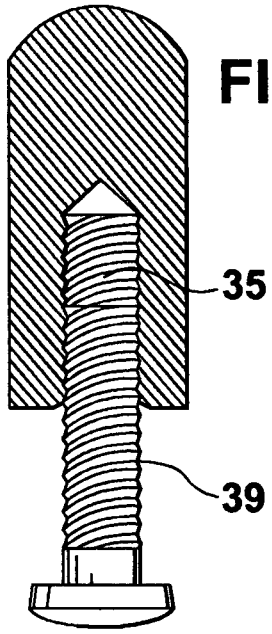
FIG. 3D is a vertical sectional view taken along the line D-D of FIG. 3C.
Figure 3E:
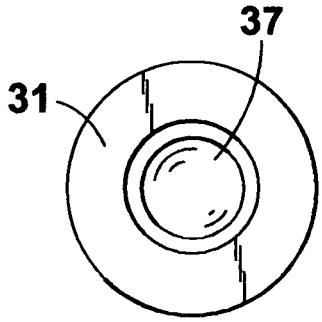
FIG. 3E is a bottom view of a standoff device shown in FIG. 3C.

FIGS. 3A and 3B further illustrate the installation of rail pull by using the standoffs according to the present invention. As seen in FIG. 3A the rail pull 27 is aligned over the drawer top 11 and the standoffs, such as the standoff 25, are secured thereto as hereinbefore described.

Figure 4A:
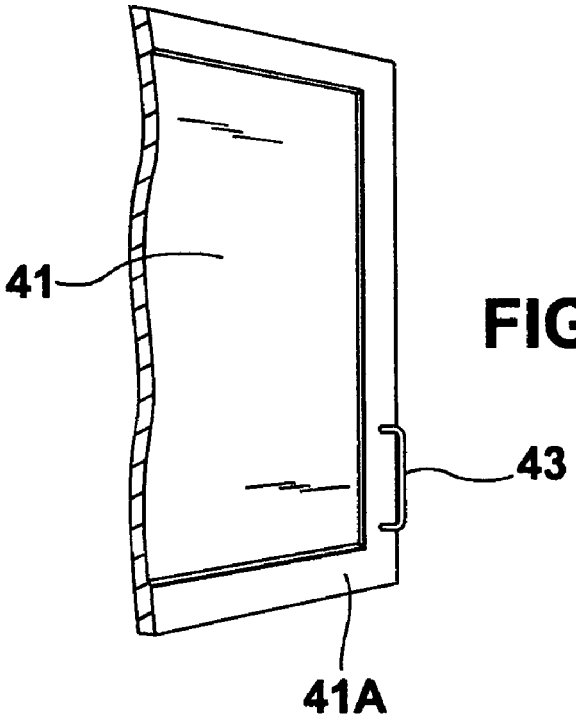
FIG. 4A illustrates a front view of a drawer with a pull located at one end thereof.
Figure 4B:
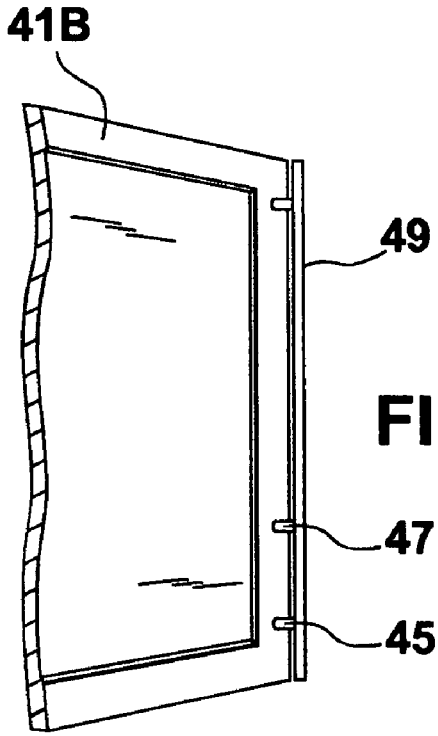
FIG. 4B is a view of the same drawer shown in FIG. 4A with an European-style rail pull installed using the standoff of the present invention.

FIGS. 4A and 4B further illustrate the use of standoffs of this invention. Thus, as shown in FIG. 4A, a cabinet door 41 has pre-installed conventional short pull 43 which can be removed, and the exposed holes are thereafter covered at the end 41A of the cabinet doors by the standoffs 45,47 secured to the European-style rail pull 49. For enhanced rigidity, the rail pull 49 is secured at the other end 41B of the cabinet door by a similar standoff which may be pre-installed.

Thus, as it can be appreciated from the foregoing description and the drawings, regardless of the position of the previously installed knobs of pulls, the standoffs of the present invention may be used for installing the long, more attractive, and stylish European-style rail pulls which accommodate consumer appeal. The standoff device may be different in size and dimension (height) so that the rail pull can be placed at different heights above the cabinet door.

It can also be appreciated that standoffs used in the present invention may be made from a variety of metals or other attractive materials of construction. Other variations suggest themselves from the foregoing detailed description and the drawings, which are obvious to those skilled in the art and are within the scope of the present invention.

The invention claimed is:

1. Method of replacing previously installed knob or conventional rail pulls on cabinet door with European-style long rail pulls which comprises removing said knob from said cabinet door, thereby leaving an exposed hole on said cabinet door, placing a standoff device over said exposed hole, said standoff device having a generally cylindrical body portion, a bottom surface and an upper surface, said bottom surface having a central bore adapted to be aligned with said exposed hole, said central bore extending partly through said cylindrical body portion and being threaded internally, said upper surface being concave and shaped to rigidly secure an European style rail pull, placing said European style rail pull above said door knob such that said central bore is aligned with said exposed hole, means for securing said standoff device such that said upper surface of said standoff device grips the European style rail pull and rigidly securing said rail pull above said door cabinet by said standoff device.

2. The method of claim 1 wherein said means for securing said standoff device to the top of said cabinet door is an externally threaded screw member inserted through said internally threaded bore and threadedly engaging therewith.

* * * * *